United States Patent [19]

Ashcraft

[11] 4,113,644

[45] Sep. 12, 1978

[54] PROTECTED GLASSY PHOSPHATE DETERGENT ADDITIVE

[76] Inventor: William R. Ashcraft, 16202 El Camino Real, Apt. No. 921, Houston, Tex. 77058

[21] Appl. No.: 631,026

[22] Filed: Nov. 11, 1975

Related U.S. Application Data

[63] Continuation-in-part of Ser. No. 551,475, Feb. 20, 1975, abandoned.

[51] Int. Cl.[2] ..... C11D 3/06; C11D 3/37; C11D 17/00; C11D 17/06

[52] U.S. Cl. ..... 252/91; 252/89; 252/135; 252/140; 252/174; 252/179; 252/531; 252/539

[58] Field of Search ..... 252/99, 135, 131, 140, 252/179, 91, 174

[56] References Cited

U.S. PATENT DOCUMENTS

| | | | |
|---|---|---|---|
| 1,956,515 | 4/1934 | Hall | 252/109 X |
| 2,473,822 | 6/1949 | Robinson | 252/135 |
| 2,566,424 | 9/1951 | Munter | 252/175 |
| 2,568,110 | 9/1951 | Beiley | 252/135 |
| 2,572,359 | 10/1951 | Liddell | 252/135 |
| 3,516,937 | 6/1970 | Story | 252/110 |
| 3,519,570 | 7/1970 | McCarty | 252/135 |
| 3,723,327 | 3/1973 | Van Kampen | 252/110 |
| 3,749,671 | 7/1973 | Gedge | 252/89 |
| 3,847,830 | 11/1974 | Williams | 252/186 |
| 3,858,854 | 1/1975 | Win | 252/89 |
| 3,896,056 | 7/1975 | Benjamin | 252/539 |
| 3,925,262 | 12/1975 | Laughlin | 252/526 |

FOREIGN PATENT DOCUMENTS

| | | | |
|---|---|---|---|
| 7,406,306 | 11/1974 | Netherlands | 252/131 |

OTHER PUBLICATIONS

Hooker Industrial Chemicals, Data Sheet No. 904, published 1967.

*Primary Examiner*—Dennis L. Albrecht

[57] ABSTRACT

Substantially anhydrous glassy phosphate detergent additives are disclosed comprising from 1% to 90% by weight of a glassy phosphate and 10% to 99% by weight of a protective agent being a solid organic material having a melting point ranging from 110° F to 200° F. Preferably the solid organic material has a low hygroscopicity in order to minimize exposure of the glassy phosphate to moisture during storage.

6 Claims, No Drawings

PROTECTED GLASSY PHOSPHATE DETERGENT ADDITIVE

CROSS REFERENCE TO RELATED APPLICATION

This application is a continuation-in-part of copending United States Patent Application Ser. No. 551,475, filed Feb. 20, 1975 to William R. Ashcraft, now abandoned.

BACKGROUND OF THE INVENTION (1) Field of the Invention

This invention relates to glassy phosphate detergent additives and to processes for preparing detergent compositions containing glassy phosphate additives.

(2) Prior Art

The utility of glassy phosphates as an adjuvant to soap has been recognized for years. (U.S. Pat. No. 1,956,515 to Ralph E. Hall, Apr. 24, 1934.)

Glassy phosphates are known to have the property of sequestering ions of calcium, magnesium, and other polyvalent metals, and of deflocculating or dispersing certain solids, e.g., clay soils. However, they have the undesirable property in aqueous solution of being hydrolyzed to less desirable and sometimes objectionable lower phosphates, with corresponding loss of their useful properties. Thus, the incorporation of glassy phosphates into detergent compositions without hydrolysis has been beset with difficulty. For example, U.S. Pat. No. 2,568,110 to Irving Beiley et al, Sept. 18, 1951, attempted to overcome this problem by admixing a concentrated aqueous solution containing 20% to 65% glassy phosphate with a substantially hydratable salt. This approach, typical of the prior art, sought to compensate for the decomposition or hydrolysis by adding additional glassy phosphates to the composition. Specific uses of the glassy phosphates of this invention are also found in U.S. Pat. No. 3,896,056 issued July 22, 1975 to Benjamin and Connor, and the copending application of Francis, Carson and McKay, Ser. No. 587,451 filed June 16, 1975, both of which are herein incorporated by reference.

Throughout the specification and claims percentages and ratios are by weight and temperatures in degrees Fahrenheit unless otherwise indicated.

SUMMARY OF THE INVENTION

The present invention is based in part upon the discovery that the undesirable degradation of glassy phosphates used in detergent laundering compositions can be mitigated by protecting the glassy phosphate for degradation with a normally solid, organic protective agent.

In the detergent additive aspect of the invention there is provided a substantially anhydrous detergent additive comprising 1% to 90%, preferably 1% to 75% and most preferably 1% to 60% by weight of a glassy phosphate represented by the general formula $(M_2O)_x(P_2O_5)_y$ wherein M is an alkali metal, $y$ has a value in the range of from 5 to 50, and the ratio of $x:y$ lies in the range of from about 1:1 to about 1.5:1; and 10% to 99% preferably 40% to 99% by weight of a protective agent being a normally solid organic material having a melting point ranging from 100° F. to 200° F.

In the detergent composition aspect of the invention there is provided a granular detergent comprising 1 to 15 parts by weight of a detergent additive comprising 1% to 90% preferably 1% to 75% most preferably 1% to 60% by weight of a glassy phosphate having a general formula $M_{2y+2}P_{2y}O_{6y+1}$ wherein M is an alkali metal and $y$ is as defined above, and 10% to 99% preferably 40% to 99% by weight of a protective agent being a solid organic material having a melting point ranging from 100° F. to 200° F; and 85 to 99 parts by weight of detergent granules comprising 2% to 35% by weight of a surface-active agent selected from the group consisting of anionic, nonionic, ampholytic, and zwitterionic surface-active materials, and 10% to 65% by weight of a detergent builder salt.

DESCRIPTION OF THE INVENTION

The detergent additive of this invention comprises a glassy phosphate and a normally solid organic material. The glassy phosphates useful in this invention are described in U.S. Pat. No. 2,568,110 to Irving Beiley et al, Sept. 18, 1951, (herein incorporated by reference) and in *General and Inorganic Chemistry,* J. R. Partington, 4th Ed., MacMillan, 1967, (herein incorporated by reference). Glassy phosphates useful in the present invention can be represented by the formula $$(M_2O)_x(P_2O_5)_y$$

wherein M is an alkali metal, preferably sodium or potassium, $y$ lies in the range 5 to 50, preferably 7 to 12, and the ratio of $x:y$ generally lies in the range 1:1 to 1.5:1. Ratios of $x:y$ greater than 1.5:1 can be used, but such phosphates are not completely glassy in nature. The preferred glassy phosphates suitable for use are those having the general formula $$M_{2y+2}P_{2y}O_{6y+1}$$

wherein M is an alkali metal and $y$ is as defined above, made e.g., by fusing together $NaPO_3$ and $Na_4P_2O_7$ in the desired proportions. The preferred glassy phosphates are the sodium glassy phosphates having about (21) twenty-one phosphorus atoms in the molecule.

The glassy phosphates are commercially available as dry powder, fine granules, plates, and coarse granules. For example, Hexaphos ® and Glass H ® are brands of glassy phosphate manufactured by the FMC Corporation, these phosphates respectively having approximately 13 and 21 phosphorus atoms. Glass H ® is the preferred material of this range of glassy phosphates. Polyphosphates which have empirical formulae $$Na_{16}P_{14}O_{43} \text{ and } Na_{12}P_{10}O_{31}$$

are sold by the Hooker Chemical Corporation, Niagara Falls, New York.

The detergent additive of the present invention also comprises a normally solid organic material used as a protective agent. In this context "normally solid" means solid at normal ambient temperatures, i.e., below about 90° F. The normally solid organic materials of this invention melt or soften sufficiently to become fluid between a temperature of about 100° F. and about 200° F., preferably between 110° F. and 175° F., and most preferably between 120° F. and 150° F. A wide variety of materials fitting the above criteria and compatible with the glassy phosphates of this invention are useful in the context of the present invention. Preferred materials are those having appreciable solubility in water, particularly nonionic surfactant materials.

Specific examples of solid organic protective materials suitable for use in this invention are:

(1) The condensation products of one mole of a saturated or unsaturated, straight or branched chain carboxylic acid having from about 10 to about 18 carbon atoms with from about 20 to about 50 moles of ethylene oxide, which liquefy between the temperatures of about 110° F. and about 200° F. and are solid at temperatures below about 100° F. The acid moiety can consist of mixtures of acids in the above dilineated carbon atom range or it can consist of an acid having a specific number of carbon atoms within this range. The condensation product of one mole of coconut fatty acid having the approximate carbon chain length distribution of 2% $C_{10}$, 66% $C_{12}$, 23% $C_{14}$, and 9% $C_{16}$ with 35 moles of ethylene oxide is a specific example of a nonionic containing a mixture of different chain length fatty acid moieties. Other specific examples of nonionics of this type are: the condensation products of one mole of palmitic acid with 40 moles of ethylene oxide; the condensation product of one mole of myristic acid with 35 moles of ethylene oxide; the condensation product of one mole of oleic acid with 45 moles of ethylene oxide; and the condensation product of one mole of stearic acid with 30 moles of ethylene oxide.

(2) The condensation products of one mole of a saturated or unsaturated, straight or branched chain alcohol having from about 10 to about 24 carbon atoms with from about 9 to about 50 moles of ethylene oxide, which liquefy between the temperatures of about 110° F. and 200° F. and are solid at temperatures below about 110° F. The alcohol moiety can consist of mixtures of alcohols in the above-delineated carbon atom range or it can consist of an alcohol having a specific number of carbon atoms within this range. The condensation product of one mole of coconut alcohol having the approximate chain length distribution of 2% $C_{10}$, 66% $C_{12}$, 23% $C_{14}$, and 9% $C_{16}$ with 45 moles of ethylene oxide ($CNAE_{45}$) is a specific and highly preferred example of a nonionic containing a mixture of different chain length alcohol moieties. Other specific examples of nonionics of this type are the condensation products of one mole of tallow alcohol with 20 moles of ethylene oxide; the condensation products of one mole of lauryl alcohol with 35 moles of ethylene oxide; the condensation products of one mole of myristyl alcohol with 30 moles of ethylene oxide; and the condensation products of one mole of oleyl alcohol with 40 moles of ethylene oxide.

(3) Two specific examples of nonionic surface active agents suitable for use in this invention and not specifically classified herein are polyoxyethylene glyceride esters having a hydrophilic-lipophilic balance (HLB) of 18.1 and polyoxyethylene lanolin derivatives having an HLB of 17:0. Both nonionics are manufactured by Atlas Chemical Industries, Inc.; the trade name of the former is G-1300 and the trade name of the latter is G-1795.

(4) Amides which have a melting point between about 100° F. and 200° F. are also suitable for use in this invention. Specific examples are propyl amide, N-methyl amides having an acyl chain length of from about 10 to about 15 carbon atoms, pentyl anilide and anilides having a carbon chain length of from about 7 to about 12 carbon atoms, oleamide, amides of ricinoleic acid, N-isobutyl amides of pelargonic acid, capric acid, undecanoic acid and lauric acid, N-(2-hydroxyethyl) amides having a carbon chain length of from about 6 to about 10 carbon atoms, N-cyclopentyllauramide and N-cyclopentylstearamide.

(5) The polyethylene glycols and polypropylene glycols having a molecular weight of from about 1,400 to about 30,000. For example, Dow Chemical Company manufactures these nonionics in molecular weights of 20,000, 9,500, 7,400, 4,500, 3,400, and 1,450. All of these nonionics are waxlike, solids which melt between 100° F. and 200° F.

(6) The condensation products of one mole of alkyl phenol wherein the alkyl chain contains from about 8 to about 18 carbon atoms with from about 25 to about 50 moles of ethylene oxide. Specific examples of these nonionics are the condensation products of one mole of decyl phenol with 40 moles of ethylene oxide; the condensation products of one mole of dodecyl phenol with 35 moles of ethylene oxide; the condensation products of one mole of tetradecyl phenol with 35 moles of ethylene oxide; the condensation products of one mole of hexadecyl phenol with 30 moles of ethylene oxide.

(7) Fatty acids containing from about 12 to about 30 carbon atoms which melt between 100° F. and 200° F. Specific examples of these nonionics are lauric acid, myristic acid, palmitic acid, stearic acid, tallow acid or mixtures of tallow acid and coconut acid, arachidic acid, behenic acid and ligoceric acid. Fatty acids are nonionic when utilized as a conglutinating agent. When the finished granules are utilized in alkaline solutions, however, the fatty acids are saponified to soap, an anionic surface active agent. Fatty acids having from 12 to 18 carbon atoms are preferred for use herein.

(8) Fatty alcohols containing from about 16 to about 30 carbon atoms which melt between 100° F. and 200° F. Specific examples of these nonionics are 1-hexadecanol, 1-octadecanol, 1-eicosanol, 3-docosanol, 1-tetracosanol, and 1-octaosanol.

(9) The condensation products of ethylene oxide with a hydrophobic base formed by the condensation product of propylene oxide with propylene glycol. The hydrophobic portion of these compounds has a molecular weight of from about 950 to 4,000 and of course exhibits water insolubility. The addition of polyoxyethylene moieties to this hydrophobic portion tends to increase the water-solubility of the molecule as a whole, and the liquid character of the product is retained up to the point where the polyethylene content is about 50% of the total weight of the condensation product. Examples of compounds of this type include certain of the commercially available Pluronic® surfactants which are defined in the booklet "The Wonderful World of Pluronic Polyols, ® 1971 BASF Wyandotte Corporation (herein incorporated by reference).

Normally solid organic materials other than those listed above can also be used as protective agents in this invention provided they are compatible with the glassy phosphate and are of nature sufficient to protect the glassy phosphate from decomposition. Preferred organic materials have a low hygroscopicity; for example, polyethylene glycols of molecular weight 4,000 to 6,000 are reported in *Kirk Othmer Encyclopedia of Chemical Technology*, 2nd edition, volume 10, page 652, (herein incorporated by reference) as having a comparative hygroscopicity of 1, relative to 100 for glycerol. This is conveniently measured by means of a hair hygrometer as disclosed in Ibid, volume 2, pages 692 and 693, also incorporated herein by reference.

Protected glassy phosphate additives are produced by a process comprising the steps of (a) heating a normally solid nonionic material to a temperature sufficient to melt the material; (b) mixing into the melted material a glassy phosphate and thereby forming a suspension of the phosphate in the melt; and (c) cooling the suspension to form a solid material. The solid material can take several forms, e.g., flakes, prills, or a partial coating on other detergent particulates.

According to this invention, the glassy phosphate and the normally solid organic material are made into a suspension or slurry by heating the normally solid material to a temperature sufficient to melt it and mixing therewithin the glassy phosphate material. The slurry should be substantially anhydrous, i.e., it should contain less than 0.1% by weight of water. Amounts of water greater than this give rise to problems in handling the slurry on account of the water takeup by the glassy phosphate. The glassy phosphate concentration of the slurry and product made therefrom can vary over a wide range. A range of from 1% to 60%, preferably 10% to 60%, and most preferably 35% to 55% on a total slurry weight basis of glassy phosphate dispersed within the slurry has been found suitable for this invention.

After the glassy phosphate and melted material are thoroughly mixed, the slurry is next cooled and manipulated to form solidified material, e.g., by prilling as set out in U.S. Pat. No. 3,749,671 issued July 31, 1973, to Burton H. Gedge, herein incorporated by reference. Alternatively, the solidified material can be formed into particulates by grinding or flaking using conventional techniques.

The protected glassy phosphates of this invention can be added to a wide variety of washing formulations. For instance, they can be incorporated into a presoak laundry product, a laundry detergent, or an automatic dishwashing product, the level of glassy phosphate in the product being in the range of from 0.1% to 10%, preferably 1% to 5% by weight.

The protected glassy phosphate detergent additive of this invention is preferably incorporated into detergent formulations by spraying the slurry of glassy phosphate and melted material directly onto detergent granules in a rotating drum, pan granulator, fluidized bed, or the like. A two-fluid nozzle system with hot air as an atomizing agent is preferably used to spray the slurry onto the detergent granules. Another method of spraying is by simple pressure atomization.

Surfactant

In the detergent composition aspect of the invention the glassy phosphate additive can be incorporated into conventional granular detergent formulations together with a wide range of surfactants and detergent builder salts. The level of additive in the product is normally in the range of 1% to 15% by weight of the total composition, preferably from 2% to 5%, and is adjusted to deliver the desired amount of glassy phosphate to the product.

From about 1% to about 50% by weight, preferably about 5% to 25% by weight, and most preferably from about 10% to about 20% by weight of the detergent compositions can comprise an organic surfactant selected from the group consisting of anionic, nonionic, ampholytic, and zwitterionic detergents and mixtures thereof. Examples of organic surfactants of these types are described in U.S. Pat. No. 3,579,454; incorporated herein by reference, column 11, line 45 to column 13, line 64.

Water-soluble salts of the higher fatty acids, i.e., "soaps" are useful as the anionic surfactant herein. This class of surfactants includes ordinary alkali metal soaps such as the sodium, potassium, ammonium, and alkanolammonium salts of higher fatty acids containing from about 8 to about 24 carbon atoms and preferably from about 10 to about 20 carbon atoms. Soaps can be made by direct saponification of fats and oils or by the neutralization of free fatty acids. Particularly useful are the sodium and potassium salts of the mixtures of fatty acids derived from coconut oil and tallow, i.e., sodium or potassium tallow and coconut soaps.

Another class of anionic surfactants includes water-soluble salts, particularly the alkali metal, ammonium and alkanolammonium salts, of organic sulfuric reaction products having in their molecular structure an alkyl group containing from about 8 to about 22 carbon atoms and a sulfonic acid or sulfuric acid ester group. (Included in the term "alkyl" is the alkyl portion of acyl groups.) Examples of this group of synthetic surfactants which can be used in the present invention are the sodium and potassium alkyl sulfates, especially those obtained by sulfating the higher alcohols ($C_8$–$C_{18}$ carbon atoms) produced by reducing the glycerides of tallow or coconut oil; and sodium and potassium alkyl benzene sulfonates, in which the alkyl group contains from about 9 to about 15 carbon atoms in straight chain or branched chain configuration, e.g., those of the type described in U.S. Pat. Nos. 2,220,099 and 2,477,383, incorporated herein by reference (especially valuable are linear straight chain alkyl benzene sulfonates in which the average of the alkyl groups is about 11.8 carbon atoms and commonly abbreviated as $C_{11.8}$LAS).

Other preferred detergents for use herein are alkyl ether sulfates. These materials have the formula $RO(C_2H_4O)_xSO_3M$ wherein R is alkyl or alkenyl of about 10 to about 20 carbon atoms, $x$ is 1 to 30, and M is a water-soluble cation such as alkali metal, ammonium, and substituted ammonium. The alkyl ether sulfates useful in the present invention are condensation products of ethylene oxide and monohydric alcohols having about 10 to about 20 carbon atoms. Preferably, R has 14 to 18 carbon atoms. The alcohols can be derived from fats, e.g., coconut oil or tallow, or can be synthetic. Lauryl alcohol and straight chain alcohols derived from tallow are preferred herein. Such alcohols are reacted with 1 to 30, and especially 1 to 6, molar proportions of ethylene oxide and the resulting mixture of molecular species, having, for example, an average of 3 moles of ethylene oxide per mole of alcohol, is sulfated and neutralized.

Specific examples of fat-derived alkyl ether sulfates of the present invention are sodium coconut alkyl ethylene glycol ether sulfate; sodium tallow alkyl trioxyethylene ether sulfate; and sodium tallow alkyl hexaoxyethylene sulfate.

Examples of alkyl ether sulfates of synthetic origin in which the starting alcohol is a narrow-cut olefin feed stock include sodium $C_{14-15}$ alkyl trioxyethylene ether sulfate and $C_{15-16}$ alkyl trioxyethylene ether sulfate.

Other anionic surfactant compounds herein include the sodium alkyl glyceryl ether sulfonates, especially those ethers of higher alcohols derived from tallow and coconut oil; sodium coconut oil fatty acid monoglyceride sulfonates and sulfates; and sodium or potassium salts of alkyl phenol ethylene oxide ether sulfate containing about 1 to about 10 units of ethylene oxide per molecule and wherein the alkyl groups contain from about 8 to about 12 carbon atoms.

Other useful anionic surfactants herein include the water-soluble salts of esters of $\alpha$-sulfonated fatty acids containing from about 6 to 20 carbon atoms in the ester group; water-soluble salts of 2-acyloxy-alkane-1-sulfonic acids containing from about 2 to 9 carbon atoms in the acyl group and from about 9 to about 23 carbon atoms in the alkane moiety; alkene sulfonates containing from about 10 to 20 carbon atoms in the alkane group; and $\beta$-alkyloxy alkane sulfonates containing from about 1 to 3 carbon atoms in the alkyl group and from about 8 to 20 carbon atoms in the alkane moiety.

Other preferred detergents utilizable herein are olefin sulfonates having about 12 to about 24 carbon atoms. The term "olefin sulfonates" is used herein to mean compounds which can be produced by the sulfonation of $\alpha$-olefins by means of uncomplexed sulfur trioxide, followed by neutralization of the acid reaction mixture in conditions such that any sultones which have been formed in the reaction are hydrolyzed to give the corresponding hydroxy-alkane sulfonates. The sulfur trioxide can be liquid or gaseous, and is usually, but not necessarily, diluted by inert diluents, for example by liquid $SO_2$, chlorinated hydrocarbons, etc., when used in the liquid form, or by air, nitrogen, gaseous $SO_2$, etc., when used in the gaseous form.

The $\alpha$-olefins from which the olefin sulfonates are derived are mono-olefins having 12 to 24 carbon atoms, preferably 14 to 16 carbon atoms. Preferably they are straight chain olefins. Examples of suitable 1-olefins include 1-dodecane, 1-tetradecene, 1-hexadecene, 1-octadecene, 1-eicosene, and 1-tetracosene.

In addition to the ture alkene sulfonates and a portion of hydroxy-alkane sulfonates, the olefin sulfonates can contain minor amounts of other materials, such as alkene disulfonates depending upon the reaction conditions, proportion of reactants, the nature of the starting olefins and impurities in the olefin stock and side reactions during the sulfonation process.

A specific anionic detergent which is useful in the present invention is described more fully in the U.S. Pat. No. 3,332,880 of Phillip F. Pflaumer and Adrian Kessler, issued July 25, 1967, titled "Detergent Composition", the disclosure of which is incorporated herein by reference.

Preferred nonionic surfactants useful in the present invention are those obtained by the condensation of one to twelve ethylene oxide moieties with a $C_{10}$–$C_{18}$ aliphatic alcohol. The alcohol may be completely linear as occurs in materials derived from natural feedstocks such as vegetable oils and animal fats, or may be slightly branched as occurs in petroleum-derived alcohols made by oxo-type synthesis. Particularly preferred materials are $C_{14}$–$C_{15}$ alcohol condensed with an average of seven ethylene oxide groups, $C_{12}$–$C_{13}$ alcohol condensed with an average of about four ethylene oxide groups and then subjected to stripping to remove unethoxylated and low ethoxylated materials, to leave an ethoxylate having a mean of 4.5 ethylene oxide groups.

Preferred zwitterionic materials are derivatives of quaternary ammonium compounds containing an aliphatic straight chain group of 14–18 carbon atoms and a sulfate or sulfonate anionic solubilizing group. Specific examples include 3-(N,N-dimethyl-N-hexadecyl ammonio-2-hydroxypropane-1-sulfonate; 3-(N,N-dimethyl-N-tallowyl ammonio)-2-hydroxypropane-1-sulfonate; 3-(N,N-dimethyl-N-tetradecyl ammonio)propane-1-sulfonate; and 6-(N,N-dimethyl-N-hexadecylammonio)hexanoate.

DETERGENCY BUILDERS

Detergent compositions comprising the glassy phosphate additive of the instant invention normally contain a detergent builder in an amount from about 5% to 95% by weight, preferably from about 15% to 60% by weight of the composition. Useful builders therein include any of the conventional inorganic and organic water-soluble builder salts as well as various water-insoluble and so-called "seeded" builders. In these compositions these water-soluble builder salts serve to maintain the pH of the laundry solution in the range of from about 7 to about 12, preferably from about 8 to about 11. Furthermore, these builder salts enhance the fabric cleaning performance of the overall compositions while at the same time they serve to suspend particulate soil released from the surface of the fabrics and prevent its redeposition on the fabric surfaces.

Suitable detergent builder salts useful herein can be of the polyvalent inorganic and polyvalent organic types, or mixtures thereof. Non-limiting examples of suitable water-soluble, inorganic alkaline detergent builder salts include the alkali metal carbonates, borates, phosphates, polyphosphates, tripolyphosphates, bicarbonates, silicates, and sulfates. Specific examples of such salts include the sodium and potassium tetraborates, bicarbonates, carbonates, tripolyphosphates and pyrophosphates. Of course, mixtures are also useful.

Examples of suitable organic alkaline detergency builder salts are: (1) water-soluble amino polyacetates, e.g., sodium and potassium ethylenediaminetetraacetates, nitrilotriacetates, and N-(2-hydroxyethyl)nitrilodiacetates; (2) water-soluble salts of phytic acid, e.g., sodium and potassium phytates; (3) water-soluble polyphosphonates, including, sodium, potassium and lithium salts of ethane-1-hydroxy-1,1-diphosphonic acid; sodium, potassium, and lithium salts of methylenediphosphonic acid and the like.

Additional organic builder salts useful herein include the polycarboxylate materials described in U.S. Pat. No. 2,264,103, including the water-soluble alkali metal salts of mellitic acid. The water-soluble salts of polycarboxylate polymers and copolymers such as are described in U.S. Pat. No. 3,308,067, incorporated herein by reference, are also suitable herein. It is to be understood that while the alkali metal salts of the foregoing inorganic and organic polyvalent anionic builder salts are preferred for use herein from an economic standpoint, the ammonium, alkanolammonium, e.g., triethanolammonium, diethanolammonium, and the like, water-soluble salts of any of the foregoing builder anions are useful herein.

Mixtures of organic and/or inorganic builders can be used herein. One such mixture of builders is disclosed in Canadian Pat. No. 755,038, e.g., a ternary mixture of sodium tripolyphosphate, trisodium nitrilotriacetate, and trisodium ethane-1-hydroxy-1,1-diphosphonate.

Another type of builder useful herein includes various substantially water-insoluble materials which are capable of reducing the hardness content of laundering liquors, e.g., by ion-exchange processes. Examples of such builder materials include the phosphorylated cloths disclosed in U.S. Pat. No. 3,424,545 to Bauman issued Jan. 28, 1969, incorporated herein by reference.

A further class of insoluble builder salts is the alumino silicate type which functions by cation exchange to remove polyvalent mineral hardness and heavy metal ions from solution. A preferred builder of this type has the formulation $Na_z(AlO_2)_z(SiO_2)_y \cdot x\ H_2O$ wherein $z$ and $y$ are integers of at least 6, the molar ratio of $z$ to $y$ is in the range from 1.0 to about 0.5 and $x$ is an integer from about 15 to about 264 said aluminosilicate having a calcium ion exchange capacity of at least about 200 mg eq./g (equivalent to 4 meq. of calcium ion per gram); and a calcium ion exchange rate of at least about 2 grains/gallon/minute/gram. Compositions incorporating builder salts of this type are the subject of the commonly assigned U.S. Application of John Michael Corkill, Bryan L. Madison, and Michael E. Burns, Ser. No. 450,266 filed Mar. 11, 1974 and entitled "Detergent", and also the subject of Netherlands Patent Application No. 74/06306 published on Nov. 13, 1974, both disclosures being incorporated herein by reference.

Another type of detergency builder material useful in these compositions and processes comprises a water-soluble material capable of forming a water-insoluble reaction product with water hardness cations in combination with a crystallization seed which is capable of providing growth sites for said reaction product. "Seeded builder" compositions of this type are described in Belgian Pat. No. 798,856 published on Oct. 29, 1973, the disclosures of which are incorporated herein by reference.

More particularly, the seeded builders useful herein comprise a crystallization seed having a maximum particle dimension of less than 20 microns, preferably a particle diameter of from about 0.01 micron to about 1 micron, in combination with a material capable of forming a water-insoluble reaction product with free metal ions.

A seeded builder comprising a mixture of sodium carbonate and calcium carbonate is especially preferred herein. A highly preferred seeded builder comprises a 30:1 to 5:1 (wt. $Na_2CO_3$:$CaCO_3$) mixture of sodium carbonate and calcium carbonate wherein the calcium carbonate has an average particle diameter from 0.01 micron to 5 microns.

The following examples are illustrative of the present invention. All parts, percentages, and ratios set forth herein in the preceding specification and in the claims are by weight unless otherwise specified.

Optional ingredients that may also be incorporated in detergent compositions of the present invention include enzymes for removal of protein-based or carbohydrate-based stains. Enzymes for removing protein-based stains are proteolytic in nature such as those sold under the trade names "Alcalase" and "Esterase" by Novo Industries A/S Denmark or under the trade names "Maxatase" and "AZ Protease" by Gist-Brocades N.V. The Netherlands. These materials are normally incorporated at levels of up to 1% by weight, preferably 0.25% to 0.75% by weight, and are preferably coated or prilled with inert additives to minimize dust formation and improve storage stability. A wide range of enzyme materials and means for their incorporation into synthetic detergent granules is disclosed in U.S. Pat. No. 3,553,139 issued on Jan. 5, 1971, to McCarty, Roald, Deoude, Blomeyer, and Cracco which disclosure is hereby incorporated by reference.

A further ingredient that may be incorporated to improve product performance is a bleaching agent of the halogen or oxygen-containing type. Examples of the hypohalite bleach type include trichloro isocyanuric acid and the sodium and potassium dichloroisocyanurates and N-chloro and N-bromo alkane sulphonamides. Such materials are normally added at 0.5%–10% by weight of the finished product, preferably 1%–5% by weight.

Examples of oxygen-containing bleaches include sodium perborate, sodium percarbonate, and potassium non-opersulphate that are incorporated at levels of 5–30%, preferably 10–20% by weight of the final product. The inclusion of organic bleach activators such as phthalic anhydride, tetra acetyl ethylene diamine, tetra acetyl methylene diamine or tetra acetyl glycouril lead to the in situ production during the washing process of the corresponding organic epoxy acids which have enhanced low temperature bleaching performance. Activators of this type are normally used with sodium perborate, at usage levels of 5–15% by weight of the final product.

Materials to boost or modify the sudsing pattern of the compositions of the present invention may also be included. Examples of suds boosters include coconut and tallow mono- and di-alkanolamides, particularly ethanolamides and $C_{12-15}$ alkyl di-lower alkyl amine oxides. Typical suds depressors include long chain fatty acids such as those disclosed in U.S. Pat. No. 2,954,347 issued Sept. 27, 1960, to Wayne St. John and combinations of certain nonionics therewith as disclosed in U.S. Pat. No. 2,954,348 issued Sept. 27, 1960, to Eugene Schwoeppe, both disclosures being incorporated herein by reference.

Other optional ingredients in granular products include hydrotropes and anticaking additives such as salts of lower alkyaryl sulphonic acids, salts of α-sulphosuccinic acid, and α-sulphobenzoic acid, and urea, normally utilized at levels of 0.5% to 5% by weight of the final product, preferably at levels of 1%–3% by weight. $C_{12}$–$C_{18}$ alkyl acid phosphates and their condensation products with ethylene oxide may also be incorporated at similar levels for control of crutcher mix viscosity. Antiredeposition agents such as carboxymethyl cellulose, hydroxyethyl cellulose, and their derivitives may also be incorporated.

Advantageously, ingredients may also be included to minimize the wrinkling of fabrics that occurs during conventional drying processes. Detergent products incorporating starch and other particulate materials useful as fabric conditioning agents are disclosed in Belgian Pat. No. 811,082 published Aug. 16, 1974, and incorporated herein by reference. A non-limiting example of such a fabric conditioning agent is corn starch, which can be added at a level of 0.1–5.0% by weight of the composition, preferably 0.25–1.0%.

Anti-tarnish and anti-corrosion agents, perfume and colour may also be included, the last ingredient being conveniently added either as a general colour or in the form of a speckle applied to a separate granule fraction of the entire formulation or to a granulate of one or more of the ingredients.

The pH of detergent formulations in accordance with the present invention can lie anywhere within the range 5–12 but is preferably chosen to fall within the range 8.0–10.5 as this provides a slight particulate soil removal benefit on synthetic fabrics. However, the use of specific optional components such as enzymes may require the selection of a product pH that will permit optimum functioning of the component concerned.

The following examples illustrate the production, according to this invention, of glassy phosphate additives and their inclusion in detergent compositions.

EXAMPLE I

A detergent base granule having the formulation shown below was prepared using conventional techniques of mixing in a crutcher and spray drying.

| Base Granule | Parts by Weight |
|---|---|
| Linear alkyl benzene sulfonate (average alkyl chain of 11.8) | 14.0 |
| Alkyl ethoxylate sulfate (average alkyl chain of $C_{15}$ and average ethoxylation of 3.0) | 6.0 |
| Sodium tripoly/pyro/orthophosphate | 11.1/11.0/2.0* |
| Sodium silicate ($SiO_2$:$Na_2O$ ratio of 2:1) | 12.0 |
| Sodium sulfate | 36.0 |
| Water | 6.0 |
| Additives | |
| PEG 4000 | 0.9 |
| Glassy phosphate (Glass H) | 1.0 |
| | 100.0 |

*The final distribution of phosphate salts. When the preformed detergent granules were made, a portion of sodium tripolyphosphate was degraded under normal processing conditions.

90 grams of a polyethylene glycol of molecular weight 6,000 were heated to a temperature of about 150° F. in a stirred container. 100 grams of Glass H®, a glassy phosphate having approximately 21 phosphorus atoms per molecule, were added and a slurry was formed containing 52.6% glassy phosphate.

The base granules were tumbled in an inclined pan granulator and the heated slurry sprayed onto the tumbling mass by means of a heated two-fluid nozzle using heated air as the second fluid. The spray on was adjusted to give a level of additive in the product of 1.9% by weight. The resultant glassy phosphate-containing granules were then cooled to provide a free-flowing product.

For comparison purposes, a similar composition was made up in which the glassy phosphate was added at the crutcher and exposed to the conventional mixing and spraydrying steps used to manufacture spray-dried synthetic detergent granules. Samples of this material and that made in accordance with the invention were then analyzed for initial glassy phosphate content and subjected to storage testing. Results of this comparison are shown in the following table.

| Time Elapsed | Storage Condition | Crutching | % Glass H Remaining Spray-On |
|---|---|---|---|
| 0 | (After Processing) | 40% | 100% |
| 7 days | 80° F, 60° RH | 0% | 100% |
| 21 days | 80° F, 60° RH | 0% | 100% |
| 21 days | South Florida Cycle | 0% | 100% |
| 35 days | 80° F, 60° RH | 0% | 85.7% |
| 35 days | South Florida Cycle | 0% | 85.7% |
| 42 days | 80° F, 60° RH | 0% | 85.7% |

The South Florida cycle is a storage condition simulating climatic conditions in South Florida. Typically, the temperature cycles between 80° F. and 92° F. and the humidity varies independently between 50% Relative Humidity and 87% Relative Humidity over a period of 24 hours.

It can be seen that the glassy phosphate-containing granules prepared in accordance with the invention display a resistance to degradation on storage which cannot be achieved when the glassy phosphate is incorporated in the conventional manner. It can also be seen that the glassy phosphate reverts (i.e., degrades to lower phosphate species) during processing, most of this reversion occurring in the spray-drying tower. In contrast, little or no degradation of the glassy phosphate incorporated in accordance with the invention occurred either in processing or storage under the same conditions.

EXAMPLE II

A detergent base granule having the formulation shown in Example I was prepared using conventional techniques.

270 pounds of "Carbowax 4000", a polethylene glycol having an average molecular weight of 4000, was melted to a temperature of about 150° F. in an agitated container. To this melt was added 300 pounds of Glass H®, and a slurry was formed containing 52.6% glassy phosphate.

The slurry was pumped to a two-fluid spray nozzle located in a rotating mix drum at the base of the spray-drying tower used to form the base detergent granule. The spray nozzle had an orifice of 0.1 inch diameter and used hot air as the second fluid. Detergent granules were fed into the rotating drum and were exposed to the slurry spray which was adjusted to give a level of additive in the product of 1.9%. The resultant glassy phosphate-containing detergent granules were then cooled to provide a free-flowing product. No reversion took place on processing. Product made in this manner displays a similar storage stability to that of the product of Example I.

The following examples are of slurry compositions that, when cooled and flaked, prilled, or as in Example I, sprayed onto detergent granules, produce protected glassy phosphate additives useful in detergent compositions.

EXAMPLE III

| | |
|---|---|
| Condensation product of one mole of coconut alcohol and 45 moles of ethylene oxide (heated at 135° F to melt) | 50 lbs. |
| Glassy phosphate (Glass H®) | 35 lbs. |

EXAMPLE IV

| | |
|---|---|
| "Carbowax 6000"[1] (heated to 150° F) to melt) | 50 lbs. |
| Glassy phosphate (Glass H®) | 1 lb. |

1 *Carbowax 6000 is a polyethylene glycol of molecular weight 6000 to 7500 made by the Union Carbide Corporation*

EXAMPLE V

| | |
|---|---|
| "Carbowax 4000" | 50 lbs. |
| Sodaphos® (defined above) | 25 lbs. |

EXAMPLE VI

| | |
|---|---|
| "Carbowax 6000" (heated to 150° F) to melt) | 90 lbs. |
| Glassy phosphate (Glass H®) | 10 lbs. |

EXAMPLE VII

| | |
|---|---|
| "Carbowax 6000" (heated to 150° F to melt) | 1 lb. |
| Glassy phosphate (Glass H ®) | 99 lbs. |

Satisfactory additive products in accordance with the invention are also obtained when the following materials are substituted, either wholly or in part, for the above exemplified, normally-solid organic materials: the condensation product of one mole of coconut fatty acid having the approximate chain length distribution of 2% $C_{10}$, 66% $C_{12}$, 23% $C_{14}$, and 9% $C_{16}$ with 35 moles of ethylene oxide; the condensation product of one mole of palmitic acid with 40 moles of ethylene oxide; the condensation product of one mole of myristic acid with 35moles of ethylene oxide; the condensation product of one mole of oleic acid with 45 moles of ethylene oxide; and the condensation product of one mole of stearic acid with 30 moles of ethylene oxide, the condensation product of one mole of 2-methyl tetradecanoic acid with 45 moles of ethylene oxide; the condensation product of one mole of tallow alcohol with 20 moles of ethylene oxide; the condensation product of one mole of lauryl alcohol with 35 moles of ethylene oxide; the condensation product of one mole of myristic alcohol with 30 moles of ethylene oxide; the condensation product of one mole of 2-methyl tetradecanol with 45 moles of ethylene oxide; the condensation product of one mole of oleyl alcohol with 40 moles of ethylene oxide; polyoxyethylene glyceride esters, having a hydrophile-lipophile balance of about 18:1; polyoxyethylene lanolin derivatives having a hydrophile-lipophile balance of about 17.0; polyethylene glycols having a molecular weight of from about 1400 to about 30,000, e.g., 20,000, 9,500, 7,500, 4,500, 3,400, 1,450; mixtures of polyethylene glycols and polypropylene glycols; the corresponding product of one mole of alkyl phenol wherein the alkyl chain contains 8, 10, 12, 15, 16, or 18 carbon atoms with 25, 35, 45, or 50 moles of ethylene oxide; water-soluble amides having a melting point between 110° F. and 200° F., e.g., propyl amide, N-methyl amides having an acyl chain length of 10, 12, 14, or 15 carbon atoms, pentyl anilide and anilides having a carbon chain length of 7, 8, 10, or 12 carbon atoms, oleamide, amides of ricinoleic acid, N-isobutyl amides of pelargonic acid, capric acid, undecanoic acid, and lauric acid, N-(2-hydroxy ethyl) amides having carbon chain lengths of 6, 8, or 10 carbon atoms, N-cyclopentyllauramide, and N-cyclopentylstearamide.

What is claimed is:

1. A granular detergent consisting essentially of:
   (A) 1 to 15 parts by weight of a detergent additive comprising:
      (I) 1% to 90% by weight of a glassy phosphate having a general formula $$M_{2y+2}P_{2y}O_{6y+1}$$

wherein M is an alkali metal and $y$ is from about 7 to about 12; and
      (II) 10% to 99% by weight of a polyethylene glycol having a molecular weight from about 1,400 to about 30,000; and
   (B) 85 to 99 parts by weight of detergent granules comprising:
      (I) 2% to 35% by weight of a surface-active agent selected from the group consisting of anionic, nonionic, ampholytic, and zwitterionic surface-active materials; and
      (II) 10% to 65% by weight of a detergent builder.

2. A granular detergent according to claim 1 wherein said detergent builder is a water-soluble builder salt selected from the group consisting of alkali metal and ammonium tripolyphosphates, pyrophosphates, carbonates, silicates, and nitrilotriacetates.

3. A granular detergent according to claim 1 wherein said surface-active agent is selected from the group consisting of $C_{10}$–$C_{14}$ linear alkyl benzene sulfonates, $C_{12}$–$C_{20}$ linear alkyl sulfates; and condensation products thereof with from 1 to 4 ethylene oxide units, and $C_{12}$–$C_{16}$ aliphatic alcohols condensed with an average of from 4 to 7 ethylene oxide groups.

4. A granular detergent according to claim 1 wherein said glassy phosphate has an empirical formula of $$Na_{23}P_{21}O_{64}.$$

5. A granular detergent according to claim 1 wherein said protective agent is polyethylene glycol having a molecular weight from 4,000 to 30,000.

6. A granular detergent according to claim 5 wherein said polyethylene glycol has a molecular weight of 4,000 to 8,000.

* * * * *